United States Patent [19]

Brockway

[11] 4,412,126

[45] Oct. 25, 1983

[54] INFRARED SOURCE

[75] Inventor: Richard J. Brockway, Amherst, N.H.

[73] Assignee: Sanders Associates, Inc., Nashua, N.H.

[21] Appl. No.: 345,884

[22] Filed: Feb. 4, 1982

[51] Int. Cl.[3] ..... H05B 3/10

[52] U.S. Cl. ..... 219/553; 165/183; 219/354; 219/540; 219/270; 338/51; 373/134

[58] Field of Search ..... 219/345, 349, 354, 353, 219/411, 535, 530, 540, 553, 552, 270; 338/51, 294, 329; 165/183; 313/315; 361/266; 373/134

[56] References Cited

U.S. PATENT DOCUMENTS

| | | | |
|---|---|---|---|
| 573,558 | 12/1896 | Voss | 331/51 X |
| 686,245 | 11/1901 | Bachmann et al. | 338/51 |
| 853,678 | 5/1907 | Burrows . | |
| 859,255 | 7/1907 | Roller | 338/51 X |
| 944,139 | 12/1909 | Jones . | |
| 974,389 | 11/1910 | Jones . | |
| 1,033,205 | 7/1912 | Spieden . | |
| 1,319,002 | 10/1919 | Hulbert | 219/553 X |
| 1,729,673 | 10/1929 | Kercher et al. | 219/540 X |
| 2,152,934 | 4/1939 | Trent | 219/345 X |
| 2,653,800 | 9/1953 | Anton | 165/183 X |
| 3,002,729 | 10/1961 | Welsh | 165/183 |
| 3,089,940 | 5/1963 | Norton | 219/354 X |
| 3,205,343 | 9/1965 | De Bell et al. | 219/553 |
| 3,217,973 | 11/1965 | Knauer | 230/69 |
| 3,327,093 | 6/1966 | Hager, Jr. et al. | 219/349 |
| 3,419,709 | 12/1968 | De Bell | 219/553 |
| 3,519,255 | 7/1970 | Cooper | 219/354 X |
| 3,541,225 | 11/1970 | Raciti | 338/329 X |
| 3,554,830 | 1/1971 | Riley et al. | 156/167 |
| 3,727,682 | 4/1973 | Pasternak et al. | 165/183 |
| 3,943,218 | 3/1976 | Dietze et al. | 219/553 X |
| 4,144,473 | 3/1979 | Almer | 313/315 |

FOREIGN PATENT DOCUMENTS

| | | | |
|---|---|---|---|
| 1069881 | 2/1954 | France | 361/264 |

*Primary Examiner*—Volodymyr Y. Mayewsky
*Attorney, Agent, or Firm*—Louis Etlinger; Richard I. Seligman

[57] ABSTRACT

An infrared source comprising an electrically powered, hollow cylindrical rod which operates at lower temperatures and yet has no decrease in output power is configured by increasing the outside diameter of the rod and inserting grooves therein which provide cavities increasing the apparent surface emissivity of the rod.

1 Claim, 2 Drawing Figures

INFRARED SOURCE

BACKGROUND OF THE INVENTION

This invention relates to infrared sources and more particularly infrared sources having increased electrical resistance.

There are certain equipments which use electrically heated graphite source to generate large amounts of infrared energy. These equipments include a graphite source enclosed within a transparent envelope such as a quartz window. These sources are often used in equipment where the voltage available to power the sources is fixed. Presently such sources are configured as cylindrical hollow rods. Because of the high temperatures at which such rods operate, usually on the order of 2000° K., the lifetime of such sources are limited. Generally deterioration of the sources occur by having the graphite evaporate at the very high operating temperatures and deposit on the surfaces of the enclosing transparent window, thereby decreasing the transmissivity thereof.

It is desirable to have these sources operate at lower temperatures while radiating at the same or greater power levels. This source temperature reduction can be accomplished in two ways - improving the emission characteristics of the radiating surface and increasing the radiating surface area.

This source material is not a perfect radiator, and therefore, some emission improvement is realizable.

The increase in radiating surface area may be obtained by increasing either the length or the outer diameter of the cylindrical rod. Increasing the length of the rod is impractical because if the rods are configured to fit within certain equipment having a defined size, increasing the length of the rod will cause a like increase in the size of the equipment. Therefore, such rods could not be used in currently configured equipment.

Increasing the outer diameter of the rod requires a compensating increase of the resistance. This, of course, can be done by either increasing the resistivity, increasing the length or decreasing the cross-sectional area. It is impractical to increase the resistivity since this requires a change in materials and there are very few materials which operate at the desired temperatures on the order of 2000° K. As stated before, increasing the length is impractical.

The third alternative is to decrease the cross-sectional area, by making the walls of the hollow cylindrical rods thinner. This is also undesirable since the structural integrity of the source will be severely affected.

Accordingly, it is an object of this invention to provide an improved infrared source.

It is a further object of this invention to provide an improved infrared source having higher emissivity.

SUMMARY OF THE INVENTION

Briefly, a hollow cylindrical rod of graphite which is employed as a source of infrared energy by passing an electrical current along its length is improved by increasing the outside diameter thereof (and sometimes the inside diameter) and providing macroscopic grooves in the surface thereof. These grooves reduce the cross-sectional area of the increased outside diameter rod and thereby maintain constant electrical resistance without substantially reducing structural integrity. These macroscopic grooves, in addition to reducing cross-sectional area, form cavities, effectively increasing the surface emissivity.

BRIEF DESCRIPTION OF THE DRAWINGS

The above-mentioned and other surfaces and objects of this invention will become more apparent by reference to the following description taken in conjunction with accompanying drawings, in which.

DESCRIPTION OF A PREFERRED EMBODIMENT

Figure 1:
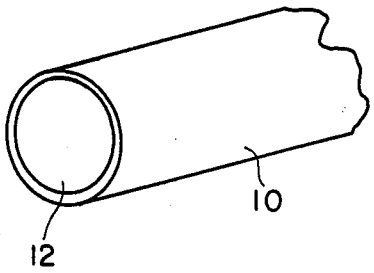
FIG. 1 (PRIOR ART)
FIG. 1 is a perspective drawing illustrating a conventional infrared source.

Referring now to FIG. 1 of the drawings, there is illustrated thereby an infrared source as currently being employed. This infrared source comprises a cylindrical rod 10 having a hole 12 therein. The rod is typically made of graphite since it is desired that it survive operating temperatures on the order of 2000° K. when heated electrically by passing an electrical current therethrough. The rod when heated emits infrared radiation. The emissivity of such a rod is approximately 0.9. As mentioned above, this rod does present problems in that at the operating temperatures it evaporates graphite onto a transparent tube enclosing the rod decreasing the transmissivity thereof.

Figure 2:
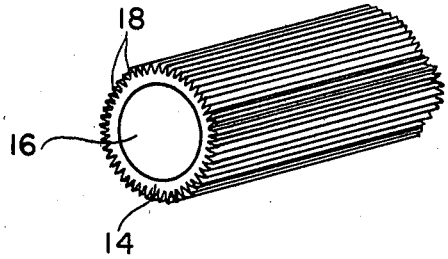
FIG. 2 is a perspective drawing illustrating an infrared source as modified in accordance with the teachings of this invention.

Referring now to FIG. 2 of the drawings, there is illustrated thereby an improved infrared source having an increased outer diameter. This source includes a rod 14 also having a hole 16 therein, however, further having macroscopic grooves 18 in its exterior surface. For clarity the grooves have been shown as relatively deep, however, in actual practice they will be extremely small on the order of 0.01 to 0.02 inches so as to minimize any decrease in structural integrity of the rod. The macroscopic grooves can be spirally threading the rod or drawing it through a broaching die, for example. Because of the grooving of the source, material is removed thereby maintaining the electrical resistance notwithstanding the increased diameter of the rod. With the increased outer diameter the rod will operate at decreased temperatures, therefore, decreasing the amount of evaporation of graphite from the rod. Furthermore, the grooving of the rod provides cavities increasing the apparent surface emissivity of the rods. It has been found that the emissivity can be increased on the order of 10%.

The fact that the grooved rod has improved emissivity is a result of the creation of multiple cavities. It can best be explained if the rod is thought of as a collector rather than as an emitter since it is known that elements that have higher collection capability will have a like improved emission capability. It is readily apparent that if the rod of FIG. 1 is considered as a collector, any radiation impinging on the smooth surface thereof will either be absorbed or bounce off the rod with only a single bounce. In the rod of FIG. 2, it is apparent that some of the radiation which would hit the rod and not be absorbed will bounce and hit the sides of the grooves and, thus, further provide additional bounces some of which will be collected by the rod thereby improving its collection capability.

In a typical example, a prior art 4.5 inch rod having an outside diameter (OD) of 0.163 inches and an inside diameter (ID) of 0.125 inches when operating from a 28 volt source radiated approximately 1360 watts at 2000° K. Rods configured in accordance with FIG. 2 also radiated 1360 watts but at reduced operating temperatures. Typical configured rods are illustrated in the table below:

| ID | OD | Groove | Temperature |
|---|---|---|---|
| .125 | .183 | .12 | 1940° K. |
| .150 | .198 | .015 | 1900° K. |
| .158 | .210 | .012 | 1875° K. |

While the grooves shown for the improved infrared source assume a sawtooth configuration, this is exemplary only, and other configurations and other grooving can be inserted such as substantially square grooves, etc. Thus, it is to be understood that the embodiment shown is to be regarded as illustrative only and that many variations and modifications can be made without departing from the principles of the invention herein disclosed and defined by the appended claims.

I claim:

1. In an infrared source including a hollow cylindrical integral rod of a material which when heated by passing an electrical current along its length will emit thermal energy by radiation and having a requirement for constant rod length and voltage, means for decreasing the operating temperature of the rod, comprising:

a replacement graphite rod having an increased outside diameter and irregular surface, to decrease cross-sectional areas, to maintain substantially constant resistance and greater emissivity at lower operating temperatures, said irregular surface comprising macroscopic sawtooth grooves.

* * * * *